US010927642B2

(12) United States Patent
Tveranger

(10) Patent No.: US 10,927,642 B2
(45) Date of Patent: Feb. 23, 2021

(54) DEVICE AND METHOD FOR SETTING OF PACKING

(71) Applicant: SBS TECHNOLOGY AS, Indre Arna (NO)

(72) Inventor: Jan Tore Tveranger, Garnes (NO)

(73) Assignee: SBS Technology AS, Indre Arna (NO)

( * ) Notice: Subject to any disclaimer, the term of this patent is extended or adjusted under 35 U.S.C. 154(b) by 0 days.

(21) Appl. No.: 16/509,140

(22) Filed: Jul. 11, 2019

(65) Prior Publication Data

US 2020/0095844 A1 Mar. 26, 2020

(30) Foreign Application Priority Data

Jun. 26, 2018 (NO) ..... 20180900

(51) Int. Cl.
*E21B 34/06* (2006.01)
*E21B 17/00* (2006.01)

(52) U.S. Cl.
CPC ..... *E21B 34/063* (2013.01); *E21B 17/006* (2013.01)

(58) Field of Classification Search
CPC ..... E21B 17/006; E21B 34/063
See application file for complete search history.

(56) References Cited

U.S. PATENT DOCUMENTS 5,533,571 A 7/1996 Surjaatmadja et al.
5,947,204 A * 9/1999 Barton ..... E21B 33/1295 166/317
7,673,677 B2 * 3/2010 King ..... E21B 34/14 166/193
8,522,936 B2 * 9/2013 Lembcke ..... E21B 34/14 188/375
9,068,428 B2 * 6/2015 Mazyar ..... E21B 33/12
9,850,734 B2 * 12/2017 Wee ..... E21B 33/12
2010/0032151 A1 * 2/2010 Duphorne ..... E21B 23/02 166/55
2011/0000663 A1 * 1/2011 Brandsdal ..... E21B 33/12 166/178
2012/0125631 A1 * 5/2012 Entchev ..... E21B 33/12 166/376
2014/0116721 A1 * 5/2014 Hofman ..... E21B 33/00 166/373
2016/0281455 A1 * 9/2016 Brandsdal ..... E21B 33/12
2017/0089175 A1 3/2017 Doane et al.
2017/0342806 A1 11/2017 Themig et al.
2018/0128082 A1 5/2018 Hollan et al.
2019/0032448 A1 * 1/2019 Bjorgum ..... E21B 33/1204

* cited by examiner

*Primary Examiner* — Matthew R Buck

(74) *Attorney, Agent, or Firm* — Dossey & Jones PLLC; Phillip Black

(57) ABSTRACT

A method for completion of an oil or gas well with production tubing (14), and a well tool device (1) comprising an first pipe part (20) and a second pipe part (22) each having a first end (20*a*, 22*a*), and a second end (20*b*, 22*b*) with a through channel (30), said well tool device (1) having a groove (24) provided in an interface in the through channel (30) between the first pipe part (20) and the second pipe part (22), wherein said groove (24) is accommodating a breakable obturator seat (10) made of brittle and tempered glass.

6 Claims, 5 Drawing Sheets

DEVICE AND METHOD FOR SETTING OF PACKING

FIELD OF THE INVENTION

The present invention relates to a method for completion of an oil or gas well with production tubing. The intervention also relates to a well tool device comprising a first pipe part and a second pipe part each having a first end, and a second end with a through channel.

BACKGROUND OF THE INVENTION

When installing production tubing in a well, it is preferred to run in the tubing with an open end to allow fluid circulation through the tubing end. After tubing is installed, it is preferred to be able to close the end to be able to perform a pressure test to prove well integrity, and to pressurize the tubing to activate the production packer that seals the annulus between tubing and casing. After these operations, it is preferred to leave the tubing with a full inner diameter, both for producing the well with as large inner diameter as possible, and to have access for doing interventions in the well below the tubing end. There are mainly three reasons for using the open tubing end method;

To allow the tubing to be automatically filled with the fluid that is already present in the pre-installed casing. Current solution involves tubing installed with closed end, meaning that tubing must be manually filled from surface, and that the displaced volume in casing must be pumped out. This is time consuming and a costly operation.

If there is a well control situation during tubing installation, there is a possibility to kill the well by pumping in heavy fluid in the well to achieve hydraulic overbalance to control the situation. With closed end or with a restricted circulation point, this can be challenging.

Be able to displace fluid in both tubing and annulus post tubing installation. This is to change the specific gravity to manipulate the hydrostatic pressure at depth. This can be both for well control, and for well start up.

DISCLOSURE OF THE STATE OF ART

Ball seats are commonly used in downhole intervention and completion industry. An obturator such as a ball, dart or other activation device is normally used to activate a tool, or to block a fluid flow.

One prior solution is to run the tubing in the well with closed end. This requires a plug in the tubing end, which must be removed after tubing test and packer setting.

This is costly and includes significant technical and operational risk. This method also calls for filling of tubing and draining of casing as the tubing is inserted in to the well.

Another prior solution involves mill out of metallic ball seats. Milling out a metallic seat will limit the tubing inner diameter post milling to the outer diameter of the mill bit used for milling. Since the mill will have to have a somewhat smaller diameter than the inner diameter of the tubing, a restriction will be left in the tubing where the seat used to be.

Yet another prior solution involves ball seats made from dissolvable/degradable materials. This requires a certain fluid and temperature present in the well, and it will also take some time to dissolve the seat.

Further another prior solution are collets used as ball seats. This has limitations to how much the inner diameter can change when manipulating the collet, hence it will often leave a restriction in the well, and it is also difficult to obtain a hydraulic seal in a collet.

US 2014/0116721 A1 discloses a downhole tool comprising a nested sleeve moveable from a closed position to an open position following actuation of a fluid control device. The fluid control device may selectively permit fluid flow, and thus pressure communication, into the annular space to cause a differential pressure across the shifting sleeve, and thereby moving the shifting sleeve to an open position. A static plug seat is positioned in the tubing or casing upwell of the downhole tool. When the shifting sleeve is opened, fluid flow is established through the static plug seat, allowing a dissolvable or disintegrable ball or other plug to engage the plug seat, preventing fluid flow past the plug seat to the opened downhole tool, thereby permitting pressurization of the tubing or casing, such as for a pressure test. Disintegration of the ball allows fluid communication to be re-established with the downhole tool, permitting fluid to flow through the tubing for subsequent operations.

US 2017/0342806 A1 discloses a wellbore tubing string assembly with at least one port for communicating fluid between its inner bore and its exterior, that can be actuated to move from a port-closed position to a port-exposed position using a series of deformable plugs of the same outer diameter that are placed in the inner bore, and that can deform so as to be squeezed through the inner bore, responsive to an application of force against each of the plugs. The plugs have an interference fit as they engage with the assembly at the inner bore. As a plug is squeezed through the inner bore and out of the assembly, its passage through the assembly is registered. When the number of plugs that have been so registered exceeds a predetermined threshold, the next plug that squeezes through the inner bore will cause the assembly to be actuated to the port-exposed position.

US 2010/0032151 A1 discloses a convertible downhole device comprises at least one sacrificial material to provide two or more configurations so that two or more different operations or functions are performable by the downhole device, one in which the sacrificial material is fully intact and another in which the sacrificial material is at least partially removed or disappeared. The sacrificial material may be removable through any suitable method or device, such as by contacting with a fluid, by temperature, by pressure, or by combustion, ignition, or activation of a fusible or energetic material, or crushing or breaking up of a frangible material. Upon removal of the sacrificial material, the downhole device has at least one additional configuration so that at least a second operation can be performed by the downhole device.

OBJECTS OF THE PRESENT INVENTION

One object of the present invention is to find a method and a device for completing a well which reduces operational risk and cost and at the same time leaves no restrictions in the tubing after completion.

Another object of the invention is to find a method for auto filling tubing during installation, setting production packer and obtaining full tubing inner diameter post operation.

Yet another object of the invention is to find a method and a device that allows for circulation during running tubing in the well and allows for setting a packer and pressure testing the tubing without leaving any restrictions in the tubing and without any additional runs in the well.

Further another object of the invention is to find an obturator that can damp the impact as the obturator hits the obturator seat.

Further another object of the invention is to find an obturator that produce a better seal with an obturator seat.

Another object is to provide a method in where full internal diameter of the production tubing is achieved after pressure testing is performed.

SUMMARY OF THE INVENTION

Some or all of said objects are achieved with a method for completion of an oil or gas well with production tubing, wherein the method comprises the following steps:

a) running in a tubing string open ended with a preinstalled obturator seat made of brittle and tempered glass,
b) dropping an obturator in the tubing;
c) land the obturator in the obturator seat;
d) pressurizing the tubing above the obturator seat, and preform tests and/or operation demanding increased pressure;
e) release the pressure;
f) run in hole with a crushing means;
g) shatter the brittle obturator seat by using mechanical force applied by said crushing means.

The method can include dropping an obturator with an elastomer coating.

The method can include dropping an obturator that is fully or partly dissolvable in well fluid.

The method can include setting a packer between the tubing and the casing.

The method can include performing a pressure test of the tubing.

The method can include shattering the obturator by using mechanical force applied by said crushing means.

The method can include shattering the obturator seat with a milling tool.

The method can include milling the obturator prior to milling the obturator seat.

Some or all of said objects are achieved using a well tool device comprising an first pipe part and a second pipe part each having a first end, and a second end with a through channel, said well tool device having a groove is provided in an interface in the through channel between the first pipe part and the second pipe part, said groove is accommodating a breakable obturator seat made of brittle and tempered glass.

The obturator seat of the well tool device can be made up of several pieces of glass.

The well tool device can comprise a cushioning mechanism below the obturator seat dampening impact of an obturator hitting the obturator seat.

The cushioning mechanism of the well tool device can comprise a spring below the obturator seat.

The spring can be a mechanical spring or a hydraulic spring below the obturator seat.

The cushioning mechanism of the well tool device can be an annular shaped chamber below the obturator seat, said annular chamber making up a closed volume and is filled with a compressible fluid, such as silicon oil.

DESCRIPTION OF THE FIGURES

Embodiments of the present invention will now be described, by way of example only, with reference to the following figures, wherein.

DESCRIPTION OF PREFERRED EMBODIMENTS OF THE INVENTION

The invention relates to a method and a device to be used in the completion of an oil or gas well. In the following preferred embodiments of the invention will be disclosed. The different embodiments can be combined with each other and shall not be seen upon as limiting to the scope of the protection which is defined by the claims. The wide range of possible embodiments and combination of embodiments comes as a result of the need to adapt the method, system and device to the condition under where they are to be used.

The term obturator seat is used as a general term to describe a ball seat or a seat that is made to accommodate some other type of obturator such as a dart for instance. Here after in the description ball seat is used according to the embodiments in the figures. In the claims the broader term obturator seat is used. The same applies for the terms obturator and ball.

Figure 1:
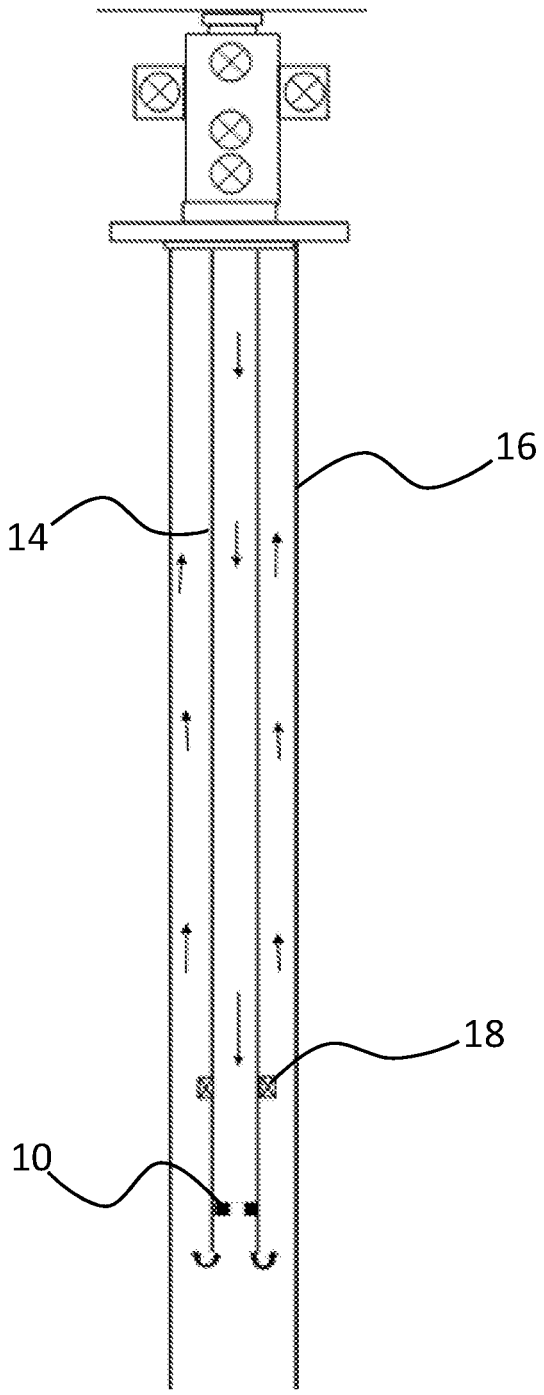
FIG. 1 shows a tubing being run into a well inside a casing.

As seen in FIG. 1 a production tubing 14 is run into the well inside a casing 16. The tubing 14 has a preinstalled packer device 18 and a preinstalled ball seat 10 close to the open end of the tubing 14. The ball seat 10 is made of a breakable and brittle material such as glass. Strengthened glass such as for instance brittle and/or tempered glass will be suitable for the application. The glass can be made up of of several pieces for instance several layers of glass to increase strength. The ball seat 10 or crushable shoulder is donut shaped, and mounted as part of a well tool device 1. The well tool device 1 is mounted in the tubing string 14 with connections that is compatible to the tubing connections. During the run in hole well, fluid can be pumped down the tubing 14, out the open end and up the annulus between the tubing 14 and the casing 16 as indicated by the arrows in FIGS. 1 and 2. The circulation of the well fluid is done by using the rig's circulation system, which is not displayed in the figures.

Figure 2:
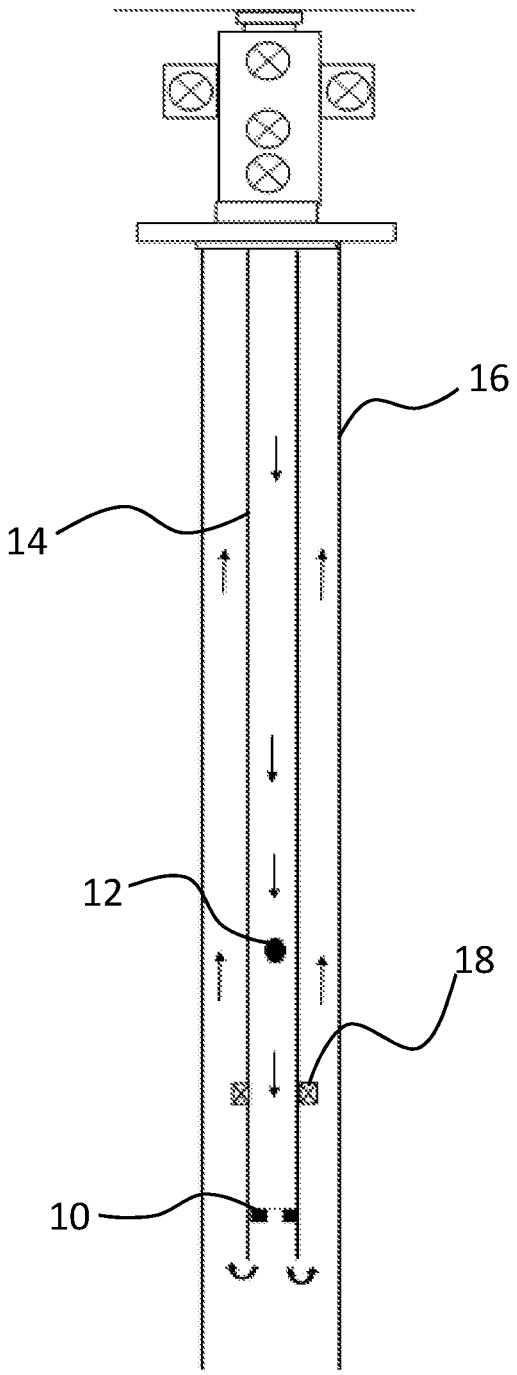
FIG. 2 shows the tubing at the desired depth inside the casing, with a drop ball traveling in the well fluid towards the ball seat.

In FIG. 2, the production tubing 14 has reached the desired depth and a ball 12 or some other type of obturator, for instance a dart, is dropped into the tubing 14 and if necessary pumped down. Before dropping the ball 12, the tubing 14 and the annulus between the tubing 14 and the casing 16 can be displaced to the preferred fluid.

Figure 3:
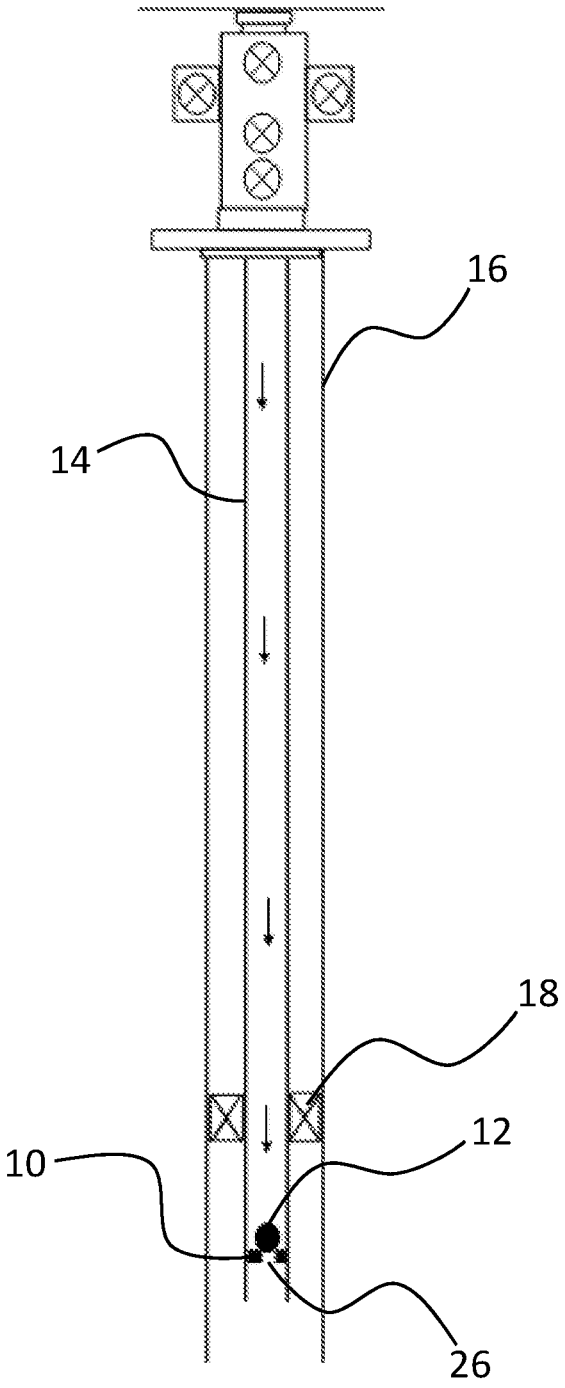
FIG. 3 shows the tubing inside the casing with the drop ball placed in the ball seat sealing of the tubing.

In FIG. 3, the drop ball has landed in the ball seat 10 sealing off the channel 26 through the ball seat 10 and pressure is applied from the surface in addition to the hydrostatic pressure, increasing the pressure inside the tubing 14 above the ball seat 10. Increasing the pressure to a predetermined value will set the packer device 18 so it seals between the tubing 14 and the casing 16. A pressure test of the tubing 14, which often is a requirement for well integrity purposes, can be preformed at this stage. In this embodiment of the invention, the ball seat 10 need to be installed below the packer device 18 (as seen in FIG. 1-5) both because the applied pressure from above need to act on the packer device 18 to set it and to be able to pressure test the needed section of the tubing 14.

Figure 4:
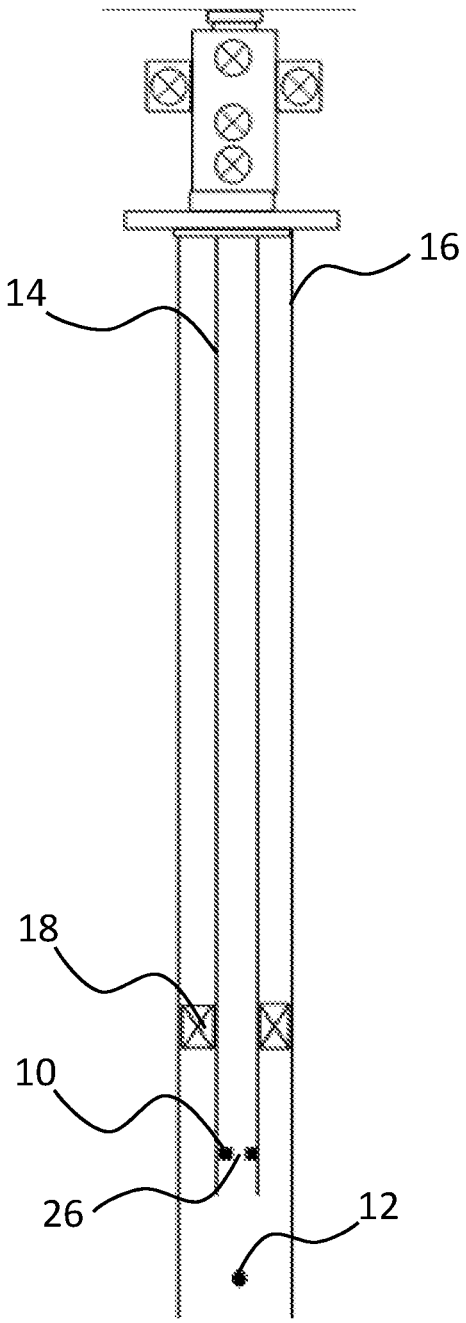
FIG. 4 shows the previously described well construction with the ball after it have fallen through the ball seat because it has started to dissolve.

In FIG. 4 one possible embodiment of the method is displayed as the ball 12, which is made of dissolvable material, have dissolved enough to fall through the seat 10 and leaving a free passage trough the channel 26 in the ball seat 10. For some applications, the use of a dissolvable ball 12 is not necessary or for other reasons not desirable and then a suitable non dissolvable ball can be used.

Figure 5:
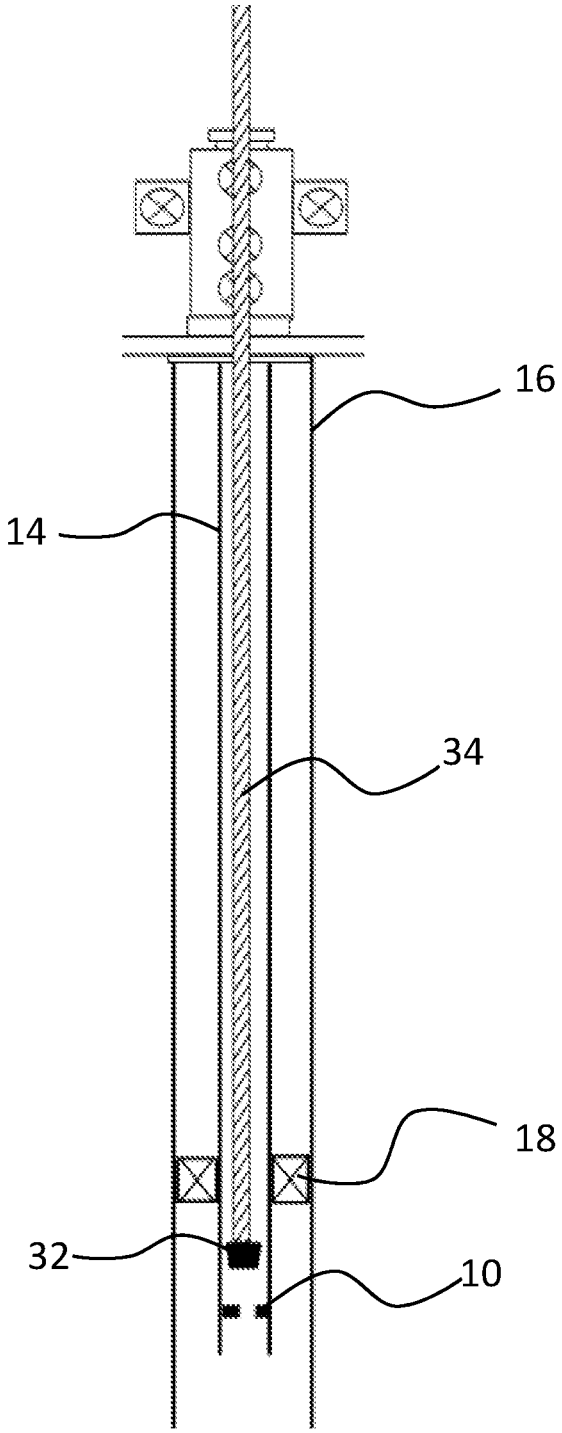
FIG. 5 shows a milling tool conveyed into the tubing to shatter the ball seat.

As seen in FIG. 5, at a desired time after the installation of the tubing 14, a crushing means such as a milling tool 32 can be conveyed into the well by means of tractor, wireline, slickline, braidedline, coiled tubing or on pipe 34 to break the ball seat 10. Because of the brittle nature of the ball seat 10, full bore will be regained as the ball seat will shatter completely unlike a conventional ball seat in a different material that will have to be milled out with a mill with an outer diameter OD smaller than the inner diameter ID of the tubing 14, leaving a restriction in the tubing 14. In case a non dissolvable ball 10 is used, the drop ball 10 needs to be milled out, removed, shattered or in other ways cleared from the wellpath to reach the ball seat 10.

Figure 6:
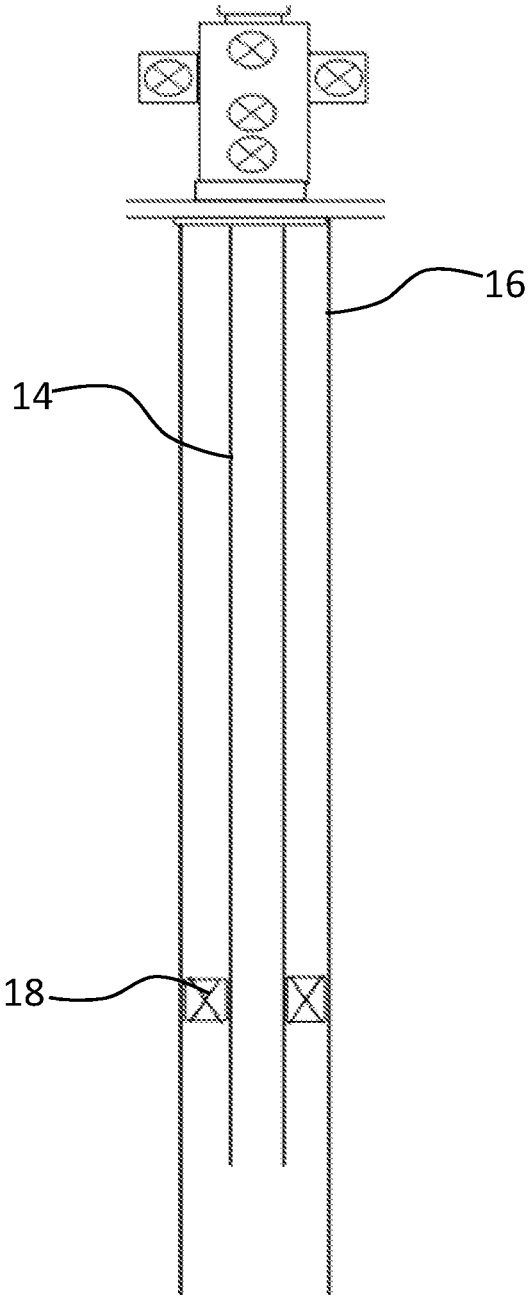
FIG. 6 shows the tubing installed inside the casing with a set packer.

FIG. 6 shows the tubing 14 installed inside the casing 16 with a set packer 18 sealing of the annulus between the casing 16 and the tubing 14. The ball seat 10 is shattered and removed leaving the tubing 14 without restrictions.

Referring now to FIGS. 7-12. The well tool device 1 with the housing 20, 22, the ball seat 10 and the ball 12 can be seen upon as a system to be used in an oil or gas well to seal of a tubular and if needed later regain fluid flow and a full bore. The system comprises a ball seat 10 and a drop ball 12, and a housing 20, 22 to accommodate the ball seat 10. These three components is the main components that makes up the system in this embodiment, but each of the main components contains sub components where some of them are displayed in the drawings and some is mention throughout the written description.

The housing 20, 22 is in one embodiment of the invention made up of two pipe parts 20 and 22 which can be joined to make up one housing 20, 22. The first end 20*a* of the housing 20 can be made up with a tubing collar that is compatible with the pin end of the tubing that is to be used in the well in question. Likewise the bottom end 22*a* of the housing 22 should be compatible with the box end of the tubing to be used in the well. Just as the first 20*a* and the second end 22*a* can be adapted to be used above and below a tubing joint it can just as well be adapted to be used above and/or below any other tubular that is part of the completion or tubing string 14. As part of the run in hole with tubing operation the well tool device 1 will be taken in on the drillfloor with care manually or mechanically and made up to the tubular in the rotary.

Figure 7:
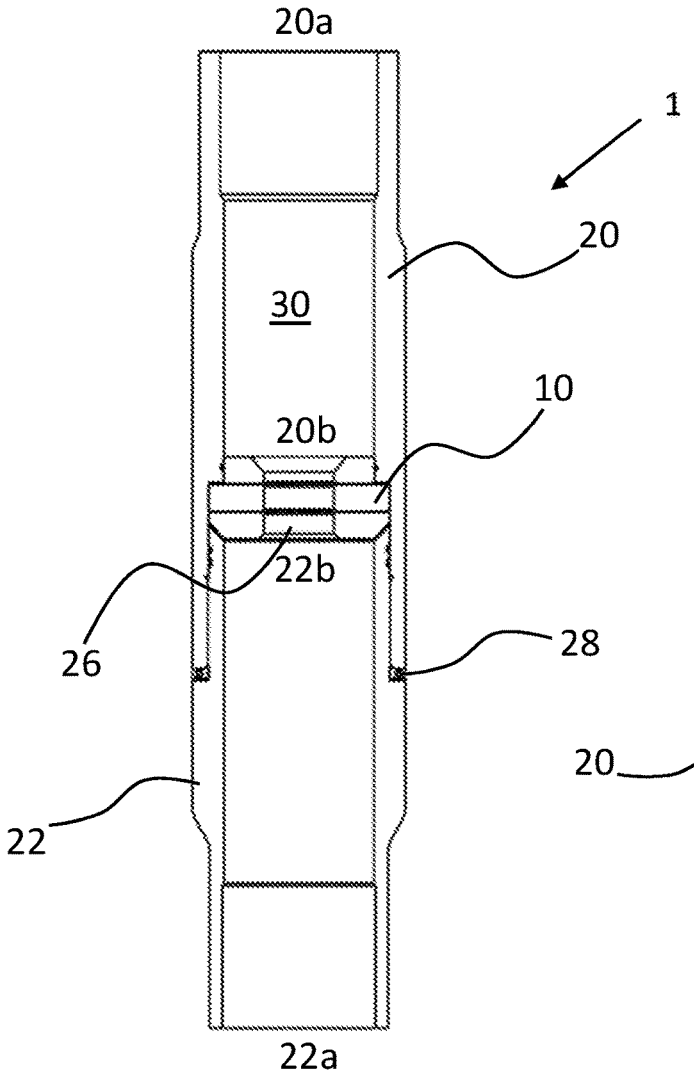
FIG. 7 shows one preferred embodiment of the well tool device as it will be run in hole.
Figure 8:
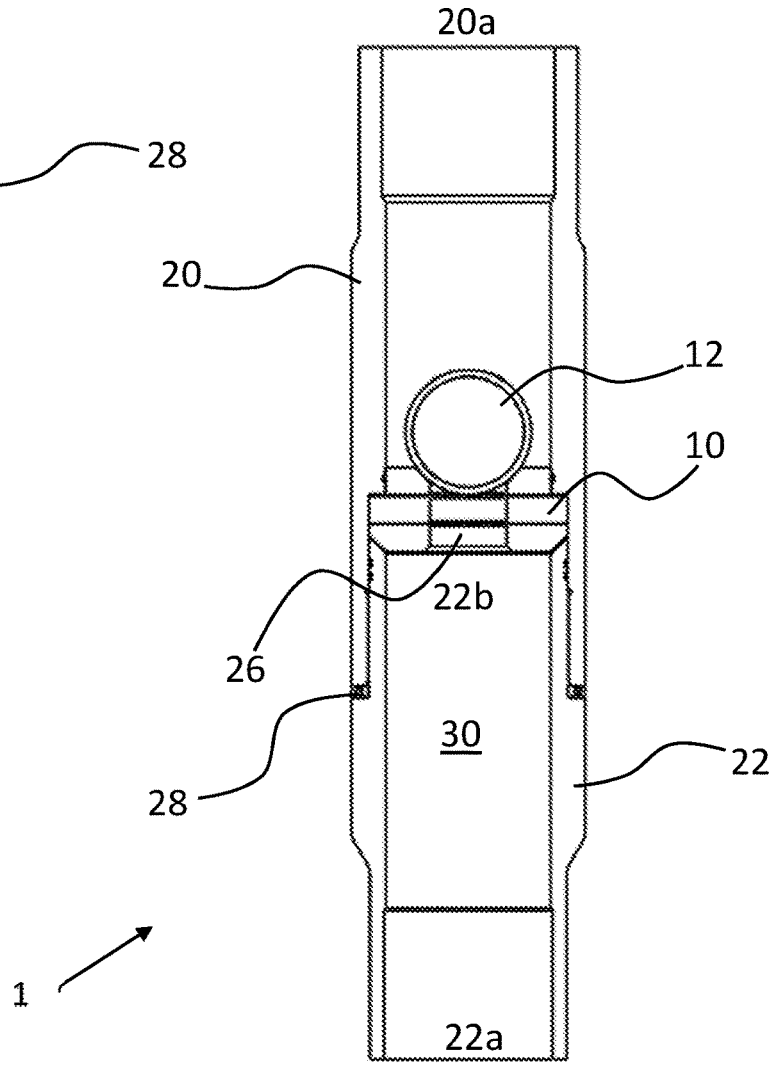
FIG. 8 shows one preferred embodiment of the well tool device after the drop ball has landed in the ball seat.
Figure 9:
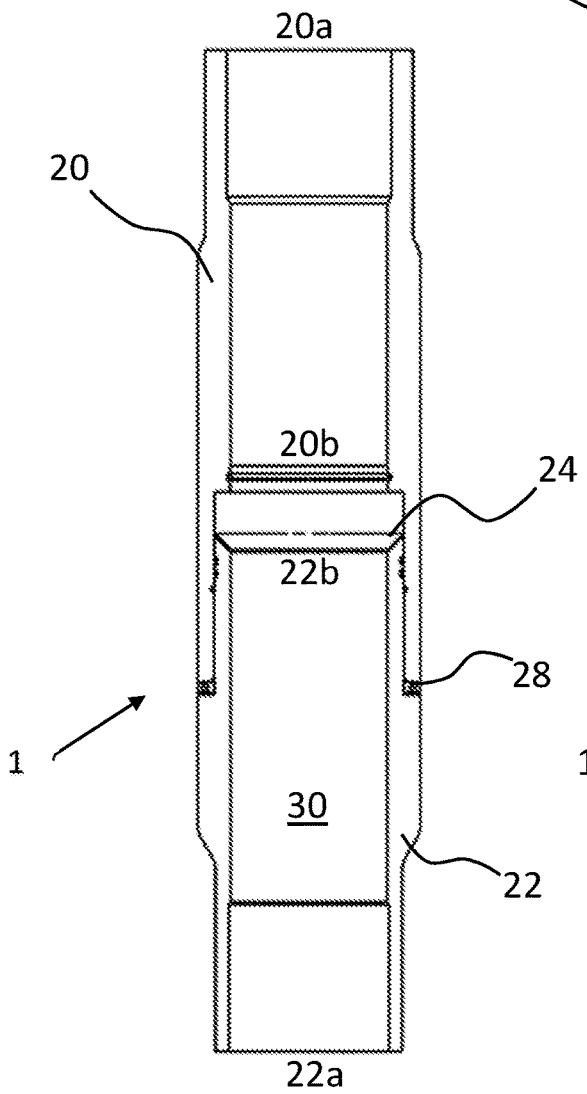
FIG. 9 shows one preferred embodiment of the well tool device after the ball seat is shattered.

As apparent from the FIGS. 7-9, the present invention relates to a well tool device 1 comprising a first pipe part 20 and a second pipe part 22, each with a first end 20*a*/22*a* and a second end 20*b*/22*b*. The first end 20*a*/22*a* of the first pipe part 20 and the second pipe part 22 is adapted to be connected to respectively the pin and the box end of the particular tubing 14 to be used in the well in question. Further the second end 20*b*/22*b* of the first and second pipe parts 20,22 is adapted to be fitted together and when fitted together to create a radial grove 24 inside the through channel 30 suitable for accommodating a ball seat 10. In the radial grove 24 (FIG. 9) there is mounted a ball seat 10, with an axial channel 26. The ball seat 10 is shaped to accommodate a drop ball 12, and to seal around the drop ball 12.

FIG. 7 shows the mode of the well tool device as it is run in hole, the ball seat is seen mounted in the grove 24 made up by the first pipe part 20 and the second pipe part 22, and the channel 26 through the ball seat 12 is open for circulation. The joining of the first pipe part 20 and the second pipe part 22 can be done by interference fit, a treaded connection or any other connection that is suitable for the particular application or well conditions. Seal between the first pipe part 20 and the second pipe part 22 can be achieved with a metal to metal seal or by the use of one or more gaskets 28. In one embodiment a ring can be placed below the seat to act as mechanical insulation between a ball seat that can be made of glass and a housing that can be made of metal. The purpose of such a ring is to avoid unintentional shattering of the ball seat.

FIG. 8 shows the mode of the well tool device 1 as the tubing 14 has reached the desired depth and the ball 12 has landed in the seat 10, and is forming a seal blocking the through channel 26.

FIG. 9 shows the mode of the well tool device 1 after the ball seat 10 is shattered. Because of the brittle nature of the ball seat 10 it shatters completely and leaves the well tool device 1 without restrictions. Preferably the minimal inner diameter of the well tool device 1 corresponds to the inner diameter of the tubing 14. The well is now ready for further interventions below the well tool device 1 or for production without the restriction of the ball seat 10.

Figure 12:
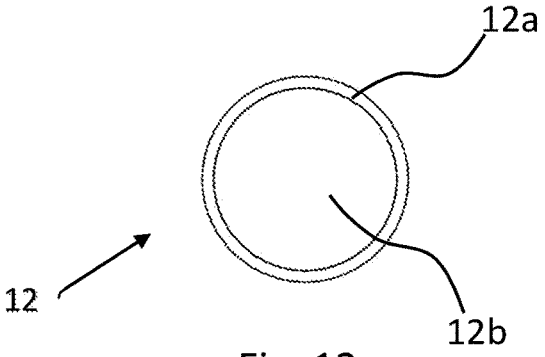
FIG. 12 shows one preferred embodiment of the drop ball.

FIG. 12 shows one preferred embodiment of the drop ball 12 in sectional view. The ball 12 comprises an outer coating 12*a* made up of elastomeric coating such as for instance rubber coating, and a core 12*b* that can be made up of metal, plastic, polymers or a combination of said materials. The elastomer coating serves as damping as the ball 12 hits the brittle ball seat 10 and helps achieving a seal between the ball seat 10 and the ball 12. In some possible embodiments of the invention the ball 12 can be fully or partly dissolvable, including the elastomer coating 12*a*. By using a dissolvable ball one can wait fora pre estimated time and the ball 12 will dissolve sufficiently to fall through the ball seat 10 and allow for circulation through the through channel 26.

In one embodiment of the invention a dart or some other object different from a drop ball 12 can be used to block and seal off the channel 26 through the ball seat 10 or crushable shoulder.

Figure 10:
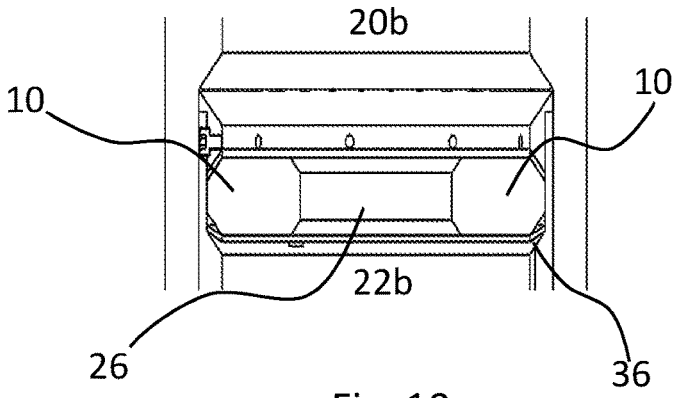
FIG. 10 shows one preferred embodiment of the well tool device which includes a damping mechanism.
Figure 11:
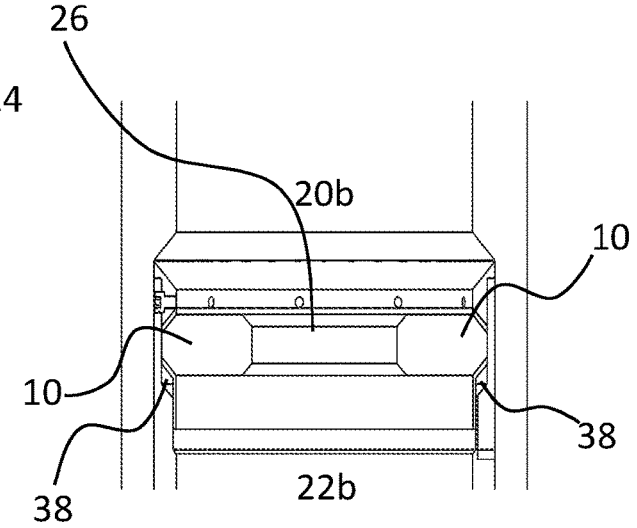
FIG. 11 shows one preferred embodiment of the well tool device which includes another damping mechanism.

In some possible embodiments of the invention as seen in FIGS. 10 and 11 the well tool device 1 comprises a cushioning mechanism for damping the impact as the ball 12 hits the ball seat 10. When ball 12 lands, there can be a significant impact, depending on the momentum of the ball 12, which again depends on the combination of mass and velocity. To avoid damage to the ball seat 10 when the ball 12 impacts, the ball 10 can as mentioned be coated with an elastomer material. Another way or a complementary way is to dampen the drop balls 12 impact is to implement the cushioning mechanism dampening system adjacent the ball seat 10. As seen in FIG. 10 this can be done by a spring on the low side of the ball seat 10. This will function like a cushion under the ball seat 10. The spring can be a mechanical spring 36, such as a Belleville spring, or a hydraulic spring 38.

In one possible embodiment seen in FIG. 11 the hydraulic dampening mechanism can be in the form of an annular shaped chamber 38 below the ball seat 10. The annular chamber 38 makes up a closed volume and is filled with a compressible fluid such as for example silicon oil.

The invention claimed is:

1. A well tool device comprising a first pipe part and a second pipe part each having a first end, and a second end with a through channel, said well tool device having a groove provided in an interface in the through channel between the first pipe part and the second pipe part, wherein the well tool device comprises a breakable obturator seat made of brittle and tempered glass positioned in the grove and a cushioning mechanism below the obturator seat dampening impact of an obturator hitting the obturator seat.

2. The device according to claim 1, wherein the obturator seat is made up of several pieces of glass.

3. The device according to claim 1, wherein the cushioning mechanism of the well tool device comprises a spring below the obturator seat.

4. The device according to claim 1, wherein the cushioning mechanism of the well tool device comprises a mechanical spring below the obturator seat.

5. The device according to claim 1, wherein the cushioning mechanism of the well tool device comprises a hydraulic spring below the obturator seat.

6. The device according to claim 1, wherein the cushioning mechanism of the well tool device is an annular shaped chamber below the obturator seat, said annular chamber making up a closed volume and is filled with a compressible fluid.

* * * * *